US006576576B1

(12) United States Patent
Wang et al.

(10) Patent No.: US 6,576,576 B1
(45) Date of Patent: Jun. 10, 2003

(54) MULTICOMPONENT FIBERS

(75) Inventors: James Hongxue Wang, Appleton, WI (US); Fu-Jya Daniel Tsai, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/474,234

(22) Filed: Dec. 29, 1999

(51) Int. Cl.[7] ..... B32B 5/16
(52) U.S. Cl. ..... 442/362; 442/363; 442/364; 428/373
(58) Field of Search ..... 428/373; 442/362, 442/363, 364

(56) References Cited

U.S. PATENT DOCUMENTS

| | | | |
|---|---|---|---|
| 3,177,270 | A | 4/1965 | Jones et al. |
| 3,323,978 | A | 6/1967 | Rasmussen |
| 3,539,666 | A | 11/1970 | Schirmer |
| 3,544,655 | A | 12/1970 | Booth et al. |
| 3,666,737 | A | 5/1972 | Lal et al. |

(List continued on next page.)

FOREIGN PATENT DOCUMENTS

| | | |
|---|---|---|
| AU | 52355/93 | 3/1994 |
| DE | 1806165 | 5/1969 |
| EP | 0080274 | 6/1983 |
| EP | 0184440 | 6/1986 |

(List continued on next page.)

OTHER PUBLICATIONS

Derwent Publications Ltd., Database WPI, JP 08 212995 (Misubishi Paper Mills Ltd.), Aug. 20, 1996.

Standard Test Method for Tensile Properties of Plastics, *American Society for Testing and Material* (*ASTM*) *Designation: D638–95*, 45–56, 1995.

Mortensen, Kell et al., Phase Behavior of Poly(propylene Oxide)–Poly(ethylene oxide)–Poly(propylene oxide) Triblock Copolymer Melt and Aqueous Solutions, *Macromolecules*, vol. 27,20, pp. 5654–5666, 1994.

Tang, Tao and Baotong Huang, Compatibilization of Polypropylene/Poly(Ethylene Oxide) Blends and Crystallization Behavior of the Blends, *Journal of Polymer Science: Part B: Polymer Physics*, 32 1991–1998, 1994.

Hu, Guo–Hua, et al., Free Radical Grafting of Chemically Activated Maleic anhydride onto Polypropylene by Reactive Extrusion—abstract only, *Annu. Tech. Conf.—Soc. Plast. Eng.*, 3 pp. 2775–2778, 1994.

Song, Z. and W.E. Baker, Melt Grafting of T–Butylaminoethyl Methacrylate Onto Polyethylene, *Polymer*, 33(15 3266–3273), 1992.

Callais, Peter A., et al., The Maleic Anhydride Grafting of Polypropylene with Organic Peroxides—abstract only, *Compalloy '90*, pp. 359–369, 1990.

Derwent Publications Ltd., Database WPI, JP 01 246411 (Sawashita A), Oct. 2, 1989.

Derwent Publications, EP 0316792 (Cassella AG), May 24, 1989 Abstract.

Bartczak, Z. and A. Galeski, Changes in Interface Shape During Crystallization in Two–Component Polymer Systems, *Polymer*, 544–548, 1986.

*Primary Examiner*—Elizabeth M. Cole
(74) *Attorney, Agent, or Firm*—Kilpatrick Stockton LLP

(57) ABSTRACT

The present invention is directed to multicomponent fibers having poly(ethylene oxide) in at least a portion of the exposed surface of the fiber. In one embodiment, the PEO is a grafted poly(ethylene oxide). The multicomponent fibers of the present may be used to manufacture nonwoven webs that can be used as components in medical and health care related items, wipes and personal care absorbent articles such as diapers, training pants, incontinence garments, sanitary napkins, pantiliners, bandages and the like.

30 Claims, 1 Drawing Sheet

U.S. PATENT DOCUMENTS 3,676,529 A 7/1972 Fall
3,717,541 A 2/1973 Schirmer
3,734,876 A 5/1973 Chu
3,763,277 A 10/1973 Chu et al.
3,830,888 A 8/1974 King
3,833,708 A 9/1974 Miller et al.
3,843,589 A 10/1974 Wartman
3,862,266 A 1/1975 McConnell et al.
3,868,433 A 2/1975 Bartz et al.
3,891,584 A 6/1975 Ray-Chaudhuri et al.
3,933,943 A 1/1976 Fahrbach et al.
3,935,141 A 1/1976 Potts
3,953,655 A 4/1976 Steinkamp et al.
3,954,928 A 5/1976 Omori et al.
3,957,605 A 5/1976 Assarsson et al.
3,963,805 A 6/1976 Chu
3,972,961 A 8/1976 Hammer et al.
3,993,551 A 11/1976 Assarsson et al.
4,018,729 A 4/1977 Faucher et al.
4,021,509 A 5/1977 Murayama et al.
4,029,720 A 6/1977 Seiler et al.
4,080,405 A 3/1978 Agouri et al.
4,200,704 A 4/1980 Stanley et al.
4,206,155 A 6/1980 Korber
4,225,650 A 9/1980 van Brederode et al.
4,229,334 A 10/1980 Klabacka et al.
4,528,334 A 7/1985 Knopf et al.
4,619,988 A 10/1986 Leung et al.
4,705,525 A 11/1987 Abel et al.
4,705,526 A 11/1987 Abel et al.
4,725,492 A 2/1988 Yazaki et al.
4,792,477 A 12/1988 Ochiumi
4,810,612 A 3/1989 Ueda et al.
4,840,851 A 6/1989 Golander et al.
4,868,222 A 9/1989 Chau et al.
4,874,540 A 10/1989 Greenwald et al.
4,883,699 A 11/1989 Aniuk et al.
5,011,892 A 4/1991 Engelhardt et al.
5,041,496 A 8/1991 Engelhardt et al.
5,059,630 A 10/1991 Fujita et al.
5,075,061 A 12/1991 Howell
5,095,619 A 3/1992 Davis et al.
5,173,539 A 12/1992 Boocock et al.
5,209,849 A 5/1993 Hu et al.
5,217,798 A 6/1993 Brady et al.
5,260,371 A 11/1993 Chen
5,300,574 A 4/1994 Bacskai
5,342,861 A 8/1994 Raykovitz
5,346,959 A 9/1994 Goman
5,354,618 A 10/1994 Ishigaki et al.
5,360,419 A 11/1994 Chen
5,360,586 A 11/1994 Wyatt et al.
5,364,907 A 11/1994 Rolando et al.
5,367,003 A 11/1994 Petcavich
5,369,168 A 11/1994 Famili et al.
5,382,703 A 1/1995 Nohr et al.
5,385,974 A 1/1995 Ohmae
5,391,423 A 2/1995 Wnuk et al.
5,395,308 A 3/1995 Fox et al.
5,412,029 A 5/1995 Elm et al.
5,415,905 A 5/1995 Middlesworth et al.
5,417,679 A 5/1995 Toms et al.
5,429,874 A 7/1995 vanPutte et al.
5,444,123 A 8/1995 Zeltner et al.
5,446,100 A 8/1995 Durrance et al.
5,468,259 A 11/1995 Sheth et al.
5,480,928 A 1/1996 Stratta
5,489,470 A 2/1996 Noda
5,489,647 A 2/1996 Kussmaul
5,498,692 A 3/1996 Noda
5,498,785 A 3/1996 Wang et al.
5,509,913 A 4/1996 Yeo
5,532,066 A 7/1996 Latiolais et al.
5,540,663 A 7/1996 Kroner et al.
5,541,259 A 7/1996 Doi
5,549,791 A 8/1996 Herron et al.
5,587,434 A 12/1996 McCullough, Jr. et al.
5,674,578 A 10/1997 Giori
5,685,757 A 11/1997 Kirsch et al.
5,700,872 A 12/1997 Wang et al.
5,753,169 A 5/1998 Kaito et al.
5,807,930 A 9/1998 Wang et al.
5,952,433 A 9/1999 Wang et al.
6,110,849 A * 8/2000 Tsai et al. ..... 442/394

FOREIGN PATENT DOCUMENTS

EP 0210754 2/1987
EP 0436966 7/1991
EP 0438598 7/1991
EP 0461785 12/1991
EP 0473091 3/1992
EP 0488119 6/1992
EP 0507561 10/1992
EP 0515949 12/1992
EP 0612773 8/1994
EP 0640650 3/1995
EP 0705934 4/1996
EP 0725090 8/1996
GB 2070046 9/1981
GB 2295553 6/1996
JP 49-126742 12/1974
JP 60195151 10/1985
JP 61-181859 8/1986
JP 61-272217 12/1986
JP 5-309111 11/1993
WO 94/00163 1/1994
WO 94/00293 1/1994
WO 94/17226 8/1994
WO 95/10645 4/1995
WO 95/11929 5/1995
WO 95/20614 8/1995
WO 95/20615 8/1995
WO 95/20621 8/1995
WO 95/23249 8/1995
WO 95/23250 8/1995
WO 96/20738 7/1996
WO 96/20831 7/1996
WO 96/21057 7/1996
WO 96/21475 7/1996
WO WO 99/27008 A 6/1999
WO WO 99/32060 A 7/1999
WO WO 00/43579 A 7/2000

* cited by examiner

MULTICOMPONENT FIBERS

FIELD OF THE INVENTION

The present invention is directed to multicomponent fibers. More particularly, the present invention is directed to multicomponent fibers including, but limited to, bicomponent polymer fibers, wherein at least a portion of the exposed surface of the fiber comprises poly(ethylene oxide), desirably a grafted poly(ethylene oxide). Such fibers can be used to manufacture nonwoven webs that can be used as components in medical and health care related items, wipes and personal care absorbent articles such as diapers, training pants, incontinence garments, sanitary napkins, pantiliners, bandages and the like.

BACKGROUND OF THE INVENTION

Disposable personal care products such as pantiliners, diapers, tampons etc. are a great convenience. Such products provide the benefit of one time, sanitary use and are convenient because they are easy to use. However, disposal of many such products is a concern due to limited landfill space. Incineration of such products is not desirable because of increasing concerns about air quality and the costs and difficulty associated with separating such products from other disposed, non-incineratable articles. Consequently, there is a need for disposable products, which may be quickly and conveniently disposed of without dumping or incineration.

It has been proposed to dispose of such products in municipal and private sewage systems. Ideally, such products would be flushable and degradable in conventional sewage systems. Products suited for disposal in sewage systems and that can be flushed down conventional toilets, in conventional tap water, are termed "flushable" herein. Disposal by flushing provides the additional benefit of providing a simple, convenient and sanitary means of disposal. In order to be commercially desirable, personal care products must have sufficient strength under the environmental conditions in which they will be used and be able to withstand the temperature and humidity conditions encountered during use and storage yet lose integrity upon contact with water in the toilet. Desirably, such products can be manufactured economically using conventional manufacturing equipment and methods. Therefore, a water-disintegratable material which is thermally processable into fibers and having mechanical integrity when dry is desirable for making nonwoven webs that can be used as components in such care articles.

Due to its unique interaction with water and body fluids, poly(ethylene oxide) (hereinafter PEO) is currently being considered as a component material in fibers and flushable products. PEO, $—(CH_2CH_2O)_n—$,
is a commercially available water-soluble polymer that can be produced from the ring opening polymerization of ethylene oxide,

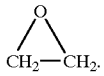

Because of its water-soluble properties, PEO is desirable for flushable applications. However, there is a dilemma in utilizing PEO in the fiber-making processes. PEO resins of low molecular weights, for example 200,000 grams per mol (hereinafter abbreviated as g/mol) have desirable melt viscosity and melt pressure properties for extrusion processing, but cannot be processed into fibers due to their low melt elasticities and low melt strengths. PEO resins of higher molecular weights, for example greater than 1,000,000 g/mol, have melt viscosities that are too high for fiber-spinning processes. These properties make conventional PEO difficult to process into fibers using conventional fiber-making processes.

Conventional PEO resins that are melt extruded from spinning plates and fiber spinning lines resist drawing and are easily broken. Conventional PEO resins do not readily form fibers using conventional melt fiber-making processes. As used herein, fibers are defined as filaments or threads or filament-like or thread-like structures with diameters of about 100 microns and less. Conventional PEO resins can only be melt processed into strands with diameters in the range of several millimeters. Therefore, PEO compositions with melt viscosities appropriate for processing fibers and with greater melt elasticities and melt strengths are desired.

In the personal care industry, flushable melt-spun fibers are desired for commercial applications. It has not been possible to melt process fibers from conventional PEO compositions using conventional fiber making techniques such as melt spinning. Melt processing techniques are more desirable than solution casting because melt-processing techniques are more efficient and economical. Melt processing of fibers is needed for commercial viability. Conventional compositions cannot be extruded into a melt with adequate melt strength and elasticity to allow attenuation of fibers. Presently, fibers cannot be produced from conventional PEO resins by melting spinning.

Thus, currently available PEO resins are not practical for melt extrusion into fibers or for personal care applications. What is needed in the art, therefore, is a means to overcome the difficulties in melt processing of PEO resins so that PEO resins can be formed easily and efficiently into fibers for later use as components in flushable, personal care products. It would also be desirable to provide water-responsive fiber compositions and structures that can be readily processed by melt spinning at high jet stretch ratios yet have desirable dry mechanical properties.

SUMMARY OF THE INVENTION

It has been discovered that water-responsive multicomponent fibers comprising at least two components: (1) a water-responsive modified or an unmodified PEO and (2) a thermoplastic, polymer that is not PEO, can be manufactured at higher jet stretch ratios compared to PEO alone. These water-responsive fibers can be made using conventional processing methods from commercially available PEO resins when modified or grafted with $\alpha,\beta$-unsaturated moieties to produce a graft copolymer of the PEO resin and the selected $\alpha,\beta$-unsaturated moiety or moieties. When a water-responsive PEO forms an exposed surface on at least a portion of the multicomponent fiber and the fibers are used to form a nonwoven web, the nonwoven web is water responsive. Advantageously, when such a web is exposed to water, such as ordinary tap water contained in a toilet bowl, the fiber to fiber bonds of the PEO exterior portions degrade and the fibrous nonwoven web will lose its integrity and break apart into smaller pieces or individual fibers that are ultimately flushable.

The non-PEO, thermoplastic component of the fibers should be water-responsive, desirably, water-weakenable and more desirably water-soluble. Desirably, the thermoplastic, non-PEO component of the multicomponent fiber is capable of being extruded and can be readily formed into fibers using conventional fiber making equipment and processes and aids in the processing of the multicomponent fibers. The non-PEO component of the multicomponent fibers can be any thermoplastic that is capable of being melt processed into fibers. Nonlimiting examples of thermoplastic polymers that can be used as the non-PEO component in the multicomponent fibers of the present invention include, but are not limited to, polyolefins and polyesters. If desired, the multicomponent fibers of the present invention can also include additional components including, but not limited to, other optional layers, polymers and additives.

The multicomponent fibers of the present invention may be manufactured in a number of forms including, but not limited to, fibers having sheath/core and side-by-side configurations. Desirably, the PEO component of the multicomponent fibers is distributed on an exterior surface of the fibers in a sufficient quantity to allow PEO/PEO bonding between fibers. More desirably, the exterior surface of the fibers is composed of a majority of PEO, i.e. greater than 50 percent by cross-sectional area. The multicomponent fibers may include other components, additives or layers and the individual components themselves may comprise additional additives, colorants and the like.

The PEO resins useful for the present invention include, but are not limited to, water-responsive PEO resins including water-disintegratable, water-weakenable, and water-soluble PEO resins. Grafted PEO compositions are particularly suitable for the present invention, particularly PEO resins grafted with polar moieties. Grafted PEO resins provide a balance between mechanical and physical properties and processing properties. Suggested polar moieties include a variety of polar vinyl monomers, oligomers, and/or polymers, as well as, any other reactive chemical species, which is capable of covalent bonding with the PEO resin. Suggested polar vinyl monomers include, but are not limited to, 2-hydroxyethyl methacrylate and poly(ethylene glycol) methacrylates such as poly(ethylene glycol) ethyl ether methacrylate.

The present invention discloses a broad class of multicomponent fibers comprising a core polymer that is not PEO and a water-soluble exterior portion, sheath or coating of PEO. Due to the water-soluble nature of PEO, it is desirable to make a multicomponent fiber structure, which has an exterior portion comprising PEO. One desirable embodiment of the present invention includes bicomponent fibers having a concentric and eccentric structure in a sheath/core configuration. The bicomponent fibers are comprised of two main components: a fiber-grade core component and a PEO sheath component. The non-PEO component of the present invention can be any thermoplastic polymer capable of being spun into fibers. Suggested non-PEO components include, but are not limited to, polyolefins and polylactides.

The present invention is further directed to nonwoven webs comprising the above-described multicomponent fibers. In one desired embodiment, the nonwoven webs are water-responsive and flushable.

DETAILED DESCRIPTION

Figure 1:
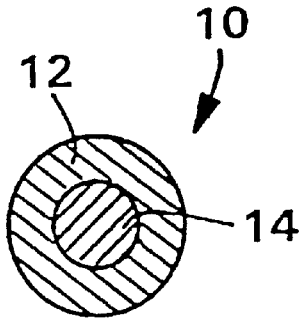
FIG. 1 is a cross-sectional view of a concentric sheath/core bicomponent fiber according to the present invention.

Fibers can be made using conventional processing methods from commercially available PEO resins when modified or grafted with α,β-unsaturated moieties to produce a graft copolymer of the PEO resin and the selected α,β-unsaturated moiety or moieties. Methods of making such modified PEO compositions are described in U.S. patent application Ser. No. 09/002,197 entitled "Method For Modifying Poly(ethylene oxide)" and U.S. patent application Ser. No. 09/001,525 entitled "Melt Processable Poly(ethylene oxide) Fibers", the entire disclosures of which are incorporated by reference. More particularly, it has been discovered that multicomponent fibers comprising at least two components: (1) modified or unmodified PEO and (2) a thermoplastic, polymer that is not PEO, can be manufactured at higher jet stretch ratios. When a water-responsive PEO forms an exposed surface on at least a portion of the multicomponent fiber and the fibers are used to form a nonwoven web, the nonwoven web is water responsive. Advantageously, when such a web is exposed to water, such as ordinary tap water contained in a toilet bowl, the fiber to fiber bonds of the PEO exterior portions degrade and the fibrous nonwoven web will lose its integrity and break apart into smaller pieces or individual fibers that are ultimately flushable.

The non-PEO, thermoplastic component of the fibers may also be water-responsive. However, most non-PEO, thermoplastic components that are easily processed into fibers are less water-degradable than PEO. Desirably, the thermoplastic, non-PEO component of the multicomponent fiber is capable of being extruded and can be readily formed into fibers using conventional fiber making equipment and processes and aids in the processing of the multicomponent fibers. The non-PEO component of the multicomponent fibers can be any thermoplastic that is capable of being melt processed into fibers. Nonlimiting examples of thermoplastic polymers that can be used as the non-PEO component in the multicomponent fibers of the present invention include, but are not limited to, polyolefins and polyesters. If desired, the multicomponent fibers of the present invention can also include additional components including, but non limited to, other optional layers, polymers and additives.

Methods of making multicomponent fibers are known and are described in U.S. Pat. No. 5,108,820 to Kaneko et al., U.S. Pat. No. 5,382,400 to Pike et al., U.S. Pat. No. 5,336,552 to Strack et al. and the patents incorporated therein, the disclosures of which are hereby incorporated herein in their entirety. Cross sections of various configurations of two components in multicomponent fibers are also described and illustrated in U.S. Pat. Nos. 5,108,820, 5,382,400 and 5,336,552 and are applicable for and within the scope of the present invention. Additionally, the multicomponent fibers of the present invention can be of various shapes and profiles. Cross sections of several shaped fibers are described and illustrated in U.S. Pat. Nos. 5,057,368 and 5,069,970 to Largman et al. and U.S. Pat. No. 5,277,976 to Hogle et al., the disclosures of which are hereby incorporated herein in their entirety.

Figure 2:
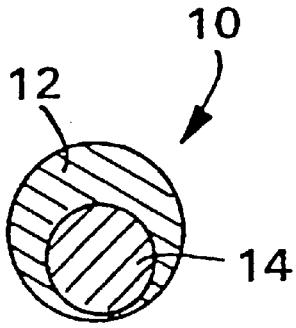
FIG. 2 is a cross-sectional view of an eccentric sheath/core bicomponent fiber according to the present invention.
Figure 3:
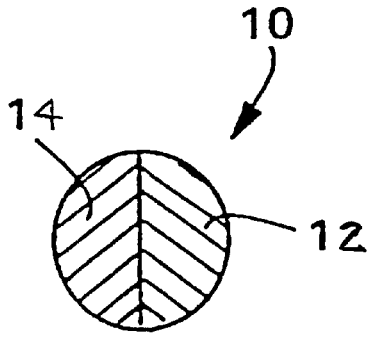
FIG. 3 is a cross-sectional view of a side-by-side bicomponent fiber according to the present invention.

The multicomponent fibers of the present invention may be manufactured in a number of forms including, but not limited to, fibers having at least a portion of their cross-section as illustrated in either FIG. 1, 2 or 3. FIGS. 1, 2, and 3 illustrate three possible cross-sections of fibers 10 comprising at least two components, a first component 12, PEO, and second component 14. Desirably, the. multicomponent fibers comprise a sheath, outer layer or coating of modified PEO compositions and have cross-section similar to those illustrated in FIGS. 1 and 2 illustrating a concentric and eccentric bicomponent fiber respectively. Nonlimiting examples of such multicomponent fibers are also demonstrated in the Examples below. As used herein with respect to fibers, the term "multicomponent" includes, but is not limited to, fibers comprising more than one component and includes bicomponent fibers made from two components. The multicomponent fibers may include other components, additives or layers and the individual components themselves may comprise additional additives, colorants and the like.

The PEO resins useful for the present invention include, but are not limited to, water-responsive PEO resins having initial reported approximate molecular weights ranging from about 50,000 g/mol to about 8,000,000 g/mol as determined by the manufacturer using rheological measurements. Desirably, the PEO resin is water soluble. More desirably, the PEO resin is modified as described in U.S. patent application Ser. Nos. 09/002,197 and 09/001,525. Higher molecular weight PEO compositions are desired for increased mechanical and physical properties, while lower molecular weight PEO compositions are desired for ease of processing. Desirable PEO compositions have molecular weights ranging from about 50,000 to about 400,000 g/mol before modification. More desirable PEO compositions have molecular weights ranging from about 50,000 to about 300,000 g/mol, even more desirably from about 50,000 to about 200,000 g/mol, before modification.

The modified PEO compositions provide a balance between mechanical and physical properties and processing properties. Two PEO resins within the above desirable ranges are commercially available from Union Carbide Corporation and are sold under the trade designations POLYOX® WSR N-10 and POLYOX® WSR N-80. These two resins have reported approximate molecular weights, as determined by rheological measurements, of about 100,000 g/mol and 200,000 g/mol, respectively. Other PEO resins available from Union Carbide Corporation within the above approximate molecular weight ranges can be used (See POLYOX®: *Water Soluble Resins*, Union Carbide Chemicals & Plastic Company, Inc., 1991 which is incorporated by reference herein in its entirety), as well as, other PEO resins available from other suppliers and manufacturers. Both PEO powder and pellets of PEO can be used in the present invention since the physical form of PEO does not affect its behavior in the melt state for grafting reactions. The present invention has been demonstrated by the use of several of the aforementioned PEO resins in powder form as supplied by Union Carbide and in pellet form as supplied by Planet Polymer Technologies, Inc. of San Diego, Calif. The initial PEO resin and modified PEO compositions may optionally contain various additives such as plasticizers, processing aids, rheology modifiers, antioxidants, UV light stabilizers, pigments, colorants, slip additives, antiblock agents, etc.

A variety of polar vinyl monomers may be useful for modifying PEO resins. Monomer(s) as used herein includes monomers, oligomers, polymers, mixtures of monomers, oligomers and/or polymers, and any other reactive chemical species, which is capable of covalent bonding with the parent polymer, PEO. Ethylenically unsaturated monomers containing a polar functional group, such as hydroxyl, carboxyl, amino, carbonyl, halo, thiol, sulfonic, sulfonate, etc. are appropriate for modifying and are desirable. Desired ethylenically unsaturated monomers include acrylates and methacrylates. Particularly desired ethylenically unsaturated monomers containing a polar functional group are 2-hydroxyethyl methacrylate (hereinafter HEMA) and poly (ethylene glycol) methacrylates (hereinafter PEG-MA). A particularly desired poly(ethylene glycol) methacrylate is poly(ethylene glycol) ethyl ether methacrylate. However, it is expected that a wide range of polar vinyl monomers would be capable of imparting the same effects as HEMA and PEG-MA to PEO and would be effective monomers for grafting.

The amount of polar vinyl monomer relative to the amount of PEO may range from about 0.1 to about 20 weight percent of monomer to the weight of PEO. Desirably, the amount of monomer exceeds 0.1 weight percent in order to sufficiently improve the processability of the PEO. A range of grafting levels is demonstrated in the Examples. Typically, the monomer addition levels are between 2.5 to 15 percent of the weight of the base PEO resin.

Suggested ethylenically unsaturated polar monomers include, but are not limited to: HEMA; poly(ethylene glycol) methacrylates (hereinafter PEG-MA), including poly(ethylene glycol) ethyl ether methacrylate; poly (ethylene glycol) acrylates; poly(ethylene glycol) ethyl ether acrylate; poly(ethylene glycol) methacrylates with terminal hydroxyl groups; acrylic acid; maleic anhydride; itaconic acid; sodium acrylate; 3-hydroxypropyl methacrylate; acrylamide; glycidyl methacrylate; 2-bromoethyl acrylate; carboxyethyl acrylate; methacrylic acid; 2-chloroacrylonitrile; 4-chlorophenyl acrylate; 2-cyanoethyl acrylate; glycidyl acrylate; 4-nitrophenyl acrylate; pentabromophenyl acrylate; poly(propylene glycol) methacrylate; poly(propylene glycol) acrylate; 2-propene-1-sulfonic acid and its sodium salt; sulfo ethyl methacrylate; 3-sulfopropyl methacrylate; and 3-sulfopropyl acrylate. A particularly desired poly (ethylene glycol) methacrylate is poly(ethylene glycol) ethyl ether methacrylate.

The present invention has been demonstrated in the following Examples by the use of PEG-MA as the polar vinyl monomer grafted on the PEO. The PEG-MA was obtained from Aldrich Chemical Company, Aldrich Catalog number 40,954-5. The PEG-MA was a poly(ethylene glycol) ethyl ether methacrylate having a number average molecular weight of approximately 246 grams per mol. PEG-MA with a number average molecular weight higher or lower than 246 g/mol is also applicable for the present invention. The molecular weight of the PEG-MA can range up to 50,000 g/mol. However, lower molecular weights are desirable for faster grafting reaction rates. The desirable range of the molecular weight of the monomers is 246 to 5,000 g/mol and the most desirable range is 246 to 2,000 g/mol. Again, it is expected that a wide range of polar vinyl monomers, as well as, a wide range of molecular weights of monomers are capable of imparting similar effects to PEO resins and would be effective monomers for grafting and modification purposes. Another desirable monomer includes 2-hydroxyethyl methacrylate, HEMA, available from Aldrich Chemical Company.

A variety of initiators may be useful for modification of the PEO. If modification of the PEO is achieved by the application of heat, as in a reactive-extrusion process, it is desirable that the initiator generates free radicals with the application of heat. Such initiators are generally referred to as thermal initiators. In order for the initiator to function as a useful source of radicals for grafting, the initiator is desirably commercially and readily available, stable at ambient or refrigerated conditions, and generate radicals at reactive-extrusion temperatures. Nonlimiting examples of initiators include compounds containing an O—O, S—S, or N═N. Compounds containing O—O bonds, peroxides, are commonly used as initiators for polymerization. Such commonly used peroxide initiators include: alkyl, dialkyl, diaryl and arylalkyl peroxides such as cumyl peroxide, t-butyl peroxide, di-t-butyl peroxide, dicumyl peroxide, cumyl butyl peroxide, 1,1-di-t-butyl peroxy-3,5,5-trimethylcyclohexane, 2,5-dimethyl-2,5-di(t-butylperoxy) hexane, 2,5-dimethyl-2,5-bis(t-butylperoxy)hexyne-3 and bis(a-t-butyl peroxyisopropylbenzene); acyl peroxides such as acetyl peroxides and benzoyl peroxides; hydroperoxides such as cumyl hydroperoxide, t-butyl hydroperoxide, p-methane hydroperoxide, pinane hydroperoxide and cumene hydroperoxide; peresters or peroxyesters such as t-butyl peroxypivalate, t-butyl peroctoate, t-butyl perbenzoate, 2,5-dimethylhexyl-2,5-di(perbenzoate) and t-butyl di(perphthalate); alkylsulfonyl peroxides; dialkyl peroxymonocarbonates; dialkyl peroxydicarbonates; diperoxyketals; ketone peroxides such as cyclohexanone peroxide and methyl ethyl ketone peroxide. Additionally, azo compounds such as 2,2'-azobisisobutyronitrile abbreviated as AIBN, 2,2'-azobis(2,4-dimethylpentanenitrile) and 1,1'-azobis(cyclohexanecarbonitrile) may be used as the initiator. The modified PEO employed in the following Examples was modified by the use of a liquid, organic peroxide initiator available from Elf Atochem North America, Inc. of Philadelphia, Pa., sold under the trade designation LUPERSOL® 101. LUPERSOL® 101 is a free radical initiator and comprises 2,5-dimethyl-2,5-di(t-butylperoxy) hexane. Other initiators and other grades of LUPERSOL® initiators may also be used, such as LUPERSOL® 130.

The present invention discloses a broad class of multicomponent fibers comprising (1) a core polymer or mixture of polymers that does not have the same composition as the resin comprising the sheath and (2) a water-soluble exterior portion, sheath or coating comprising PEO. In the embodiments disclosed in the Examples, the multicomponent fibers comprise two components: (1) a core polymer and (2) a sheath of grafted PEO. Due to the water-soluble nature of PEO, it is desirable to make a bicomponent fiber structure, which has an exterior portion comprising PEO. These fibers can be used to manufacture nonwoven webs wherein the PEO portions are used to bond the fibers and form water-responsive webs.

In a preferred embodiment, the present invention incorporates modified PEO compositions as the PEO component of the multicomponent fibers of the present invention. Such multicomponent fibers are more easily melt spun and have improved properties compared to multicomponent fibers comprising conventional PEO resins and single component fibers consisting of the above-described, modified PEO compositions. The present invention is demonstrated in the Examples by bicomponent fibers comprising a core of water-insoluble, thermoplastic polymer that can be melt spun into fibers, such as polypropylene (PP) and polylactide (PLA). Other polymers that can be melt spun into fibers may be used as the non-PEO component of the multicomponent fibers of the present invention. Nonlimiting examples of other polymers that are suggested as a component in the multicomponent fibers of the present invention include, but are not limited to: aromatic polyesters such as polyethylene terephthalate (PET), polyamides including various nylons, aliphatic polyesters, and various polyolefins such as LLDPE. The combinations illustrated in the Examples possess excellent melt spinning processability as demonstrated by the observed high jet stretch ratios. The resulting fibers also possess excellent mechanical properties, such as a high tensile strength and modulus. The bicomponent fibers also exhibit surprisingly improved ductility and tenacity when they are wet.

The multicomponent fibers demonstrated in the following examples are bicomponent fibers having a concentric and eccentric structure in a sheath/core configuration. The bicomponent fibers of the examples are comprised of two main components: (1) a fiber-grade core component and (2) a PEO sheath component. Specifically, the sheaths of the examples are made from a modified PEO composition, which has melt spinning processability. More, specifically, the sheath material is a grafted PEO. The grafted PEO can be any graft copolymer of PEO and one or more ethylenically unsaturated moieties. Suitable α,β-ethylenically unsaturated moieties include, but are not limited to, polyethylene glycol methacrylate (PEG-MA) and its derivatives such as polyethylene glycol ethyl ether methacrylate. Another suggested α,β-ethylenically unsaturated moiety is 2-hydroxyethyl methacrylate (HEMA). The grafted PEO compositions in the Examples are graft copolymers of PEO with 5.08 and 3.41 weight percent of polyethylene glycol ethyl ether methacrylate, respectively. The weight percentage of the grafted monomer, polyethylene glycol ethyl ether methacrylate, in the modified PEO was determined by NMR spectroscopy.

As stated above, the non-PEO component of the present invention can be any thermoplastic polymer capable of being spun into fibers. In the examples, the non-PEO component formed the core of the fibers and was either polypropylene (PP) or polylactide (PLA). Suggested non-PEO components include, but are not limited to, polyolefins such as polyethylenes, polypropylene, and copolymers of α-olefins. Other suggested non-PEO polymers include polyesters and poly(vinyl alcohol). Poly(vinyl alcohol) resins suggested for use as the non-PEO component in the bicomponent fibers of the present invention include various grades of poly(vinyl alcohol) resin sold under the trade name ECOMATY® by Nippon Gohsei of Japan. One suggested grade ECOMATY® poly(vinyl alcohol) resins is ECOMATY® AX-10000.

In one desirable embodiment, the core is biodegradable and comprises a hydrolytically-degradable polymer. More desirably, the core comprises a polymer or a mixture of polymers that is hydrolyzed in an aqueous environment into monomeric units that can be metabolized by organisms. Suggested hydrolitically-degradable polymers include, but are not limited to, aliphatic polyesters, such as poly(glycolic acid), poly(lactic acid), poly(hydroxybutyrate-co-valerate), poly(butylene succinate), poly(ethylene succinate), polycapralactone and polylactide-co-poly(glycolic acid). Polylactides, in the form of lactide copolymers with other cyclic esters, impart properties such as softness, pliability and biodegradability, and therefore can be used for certain embodiments of the present invention.

Another suggested fiber core material is poly(lactic acid). Poly(lactic acid) polymer is generally prepared by the polymerization of lactic acid. However, it will be recognized by one skilled in the art that a chemically equivalent material may also be prepared by the polymerization of lactide. As used herein, the term "poly(lactic acid)" is intended to include any polymer that is prepared by the polymerization of lactic acid or lactide. Examples of poly(lactic acid) polymers that are suitable for use in the present invention include a variety of poly(lactic acid) polymers that are available from Chronopol Inc., Golden, Colo. Other possible biodegradable polymers include, but are not limited to, poly(lactic acid), polybutylene succinate, polybutylene succinate-co-adipate, polyhydroxybutyrate-co-valerate, polycaprolactone, sulfonated polyethylene terephthalate, mixtures thereof, or copolymers thereof.

The core component of the multicomponent fibers can also be a thermoplastic polyolefinic material. For example, the core material may include homopolymers of polyethylene or polypropylene, or may include copolymers of ethylene and propylene. In other arrangements, the core material may include another polymer material, such as a polyether, a copolyether, a polyamide, a copolyamide, a polyester or a copolyester, as well as copolymers, blends, mixtures and other combinations thereof. Desirably, the material of the core of the multicomponent fibers is thermoplastic and melt processable. In one embodiment of the present invention, the core material has a melt flow rate (MFR) value of not less than about 1 gram per 10 minutes based on ASTM Standard D1238-L. Desirably, the MFR value is not less than about 10 grams per 10 minutes, and more desirably not less than about 20 g/10 minutes. In a further embodiment of the present invention, the MFR value is not more than 200 grams per 10 minutes. Desirably, the MFR value is not more than about 100 grams per 10 minutes, and more desirably is not more than about 40 g/10 minutes to provide desired levels of processibility.

The core material can, for example, be or include a propylene homopolymer. Commercially available polyolefins, such as Himont PF 301, PF 304, and PF 305, Exxon PP 3445, Shell Polymer E5D47, are representative of suitable thermoplastic materials that may be used as a component in the core of the multicomponent fibers of the present invention. Still other suitable materials include, for example, random copolymers, such as a random copolymer containing propylene and ethylene, e.g. Exxon 9355 containing 3.5 percent ethylene, and homopolymers, such as homopolymer polyethylene, which have MFR values similar to those described above. The polymer resins may contain small amounts, e.g. about 0.05 to 5 parts of one or more additives to 100 parts of resin. Suggested additives include, but are not limited to, calcium stearate or other acid scavengers. Other additives can include, for example, silicon glycol copolymers, organosilicone compounds, olefinic elastomers, and low molecular weight parafins or other lubricating additives. Various pigment additives may also be incorporated. For example, pigment concentrates such as a titanium dioxide pigment concentrate with low molecular weight polyethylene plasticizer can be employed as a processing additive. The various additives can have a plasticizing effect, can improve the strength and softness of the fiber, and can help facilitate one or more of the extrusion, fiber spinning, and stretching processes.

Although the multicomponent fibers of the present invention may comprise a significant amount of water-insoluble components, such as PP and PLA, nonwoven webs made from such multicomponent fibers can be manufactured that are water-responsive and flushable. Thus, another embodiment of the present invention relates to multicomponent fibers having a fiber core comprising a blend of two or more polymers. The blends may be water-sensitive, i.e., water-dispersible, water-disintegratable, or water-weakenable. Examples of such core compositions include a blend of a water-soluble polymer such as grafted PEO or a melt spinnable PVOH blended with a water insoluble polymer such as those described herein. As used herein, the term "water-dispersible" means that a nonwoven web of the fibers dissolves or breaks into pieces smaller than a 20 mesh after being immersed in water for approximately five minutes. The term "water-disintegratable" means that a nonwoven web of the fibers breaks into multiple pieces within five minutes of immersion in water and that some of the pieces will be caught by a 20 mesh screen without slipping through in the same manner as a thread through the eye of a needle. The term "water-weakenable" means that a nonwoven web of the fibers remains in one piece but weaken and lose rigidity after five minutes of immersion in water and becomes drapeable, i.e. it bends without an external force applied thereto when it is held by one side at a horizontal position. The term "water-stable" means that the fibers do not become drapeable after five minutes of immersion in water and that a nonwoven web of the fibers remains in one piece after the water response test.

Monocomponent fibers and bicomponent fibers may be prepared on a fiber spinning line. A suitable spinning line consists of two identical ¾ inch diameter 24:1 length-to-diameter extruders.

Each extruder may be equipped with 3 heating zones, a ¾ inch Koch SMX static mixer unit, and a metering pump; and a sheath/core bicomponent spin pack. The bicomponent spin pack comprises 16 holes of 12 mil diameter through which the fibers were spun. Monocomponent fibers were formed from PEO and grafted PEO for comparative purposes. Bicomponent fibers were produced using grafted PEO surrounding either a polylactide or polypropylene core. The fibers are quenched and drawn down to where they are collected into bobbins for further processing, such as crimping and cutting for production of staple and short-cut fibers, before being formed into a nonwoven web. Alternatively, the fibers can be aerodynamically drawn into a forming box with conventional spun bonding or melt blowing processes.

The utilities of the present invention can be exemplified through improved processability as quantified by the improved maximum jet stretch ratio. The jet stretch ratio is defined as the ratio of the fiber take-up speed over the linear extrusion rate of the metering pump. The higher the jet stretch ratio, the better the melt strength.

The multicomponent fibers described herein are particularly useful for making nonwoven webs. Nonwoven webs of the multicomponent fibers can be laminated or adhered to various films, foams and other nonwoven webs. Nonwoven webs and laminates of the nonwoven webs of the present invention are desirable in making both biodegradable and flushable articles, particularly personal care and health care articles. Suggested personal care articles in which nonwoven webs and laminates of nonwoven webs of the multicomponent fibers can be used include, but are not limited to, diapers, training pants feminine pads, pantiliners, adult incontinence devices, etc. Suggested health care articles in which nonwoven webs and laminates of nonwoven webs of the multicomponent fibers can be used include, but are not limited to, surgical gowns, sterilization wraps surgical masks, etc.

A few of the beneficial properties of the multicomponent fibers of the present invention are demonstrated in the Examples below.

EXAMPLES

Comparative Example A

Attempts were made to spin fibers from unmodified, ungrafted PEO resin using a conventional fiber spinning line. The unmodified, ungrafted PEO from which fibers were attempted to be processed in this Comparative Example A was a low molecular weight PEO resin obtained from Union Carbide Corporation under the trade designation POLYOX® N-80. POLYOX® N-80 has a reported average molecular weight of about 200,000 grams per mol. The PEO resin was processed in the form as obtained from the supplier. No additions or modifications were made to the PEO resin before fibers were attempted to be spun from the PEO resin.

The unmodified, ungrafted PEO resin could not be spun into monocomponent fibers using the described fiber processing apparatus and technique. The PEO resin could not be spun into a continuous fiber because of the poor melt strength of the PEO resin. Severe back coiling and fiber breakage was observed during attempts to stretch fibers from the PEO.

Comparative Example B

More successful attempts were made to spin monocomponent fibers from a grafted PEO resin using the fiber spinning line described above. The grafted PEO resin from which fibers were successfully processed in this Comparative Example B was a graft copolymer of the same low molecular weight PEO resin that was employed in Comparative Example A above. The copolymer was the product of a reactive extrusion process wherein PEO and 5.1 weight percent poly(ethylene glycol) ethyl ether methacrylate having a molecular weight of about 246 g/mol were grafted. Other than the grafting, no other additions or modifications were made to the PEO resin before fibers were spun from the grafted PEO resin. Examples 1–4

The compositions of the multicomponent fibers of Examples 1–4 and the single component fibers of the Comparative Examples A and B are presented in Table 1 below. The single component fiber of Comparative Examples A, consisting of unmodified POLYOX® N-80 PEO resin, could not be spun into a continuous fiber due to the very poor melt strength of PEO. Severe back coiling and fiber breakage upon stretching was observed. With the grafted PEO, the resin was stretched up to a jet stretch ratio of 236 mainly due to its significant improvement in melt strength of the nascent bicomponent fiber.

TABLE 1

COMPOSITION AND PROCESSING INFORMATION

| Example | Sheath | Core | Sheath to Core Weight Ratio | Maximum Jet-Stretching Ratio |
|---|---|---|---|---|
| A | Unmodified PEO | none | — | — |
| B | Grafted PEO | none | — | 118 |
| 1 | Grafted PEO | PP (PF 305) | 1 to 1 | 118 |
| 2 | Grafted PEO | PP (PF 305) | 2 to 1 | 142 |
| 3 | Grafted PEO | PLA(PLX30.1) | 1 to 1 | 157 |
| 4 | Grafted PEO | PLA(PLX30.1) | 2 to 1 | 236 |

Dry Properties of the Bicomponent Fibers

The tensile properties of the grafted PEO containing bicomponent fibers of the Examples were tested on a Sintech tensile tester. One suitable technique for determining the mechanical properties of the fibers of the Examples employs a SINTECH tensile tester, SINTECH 1/D, and TESTWORKS 3.03 software. The tensile tester and accompanying software are commercially available from MTS Systems Co., of Cary, N.C. Other equipment and software having substantially equivalent capabilities may also be employed. The testing of the fibers of the Examples was carried out using a 10 pound load cell and fiber grips. It is desirable to have grips which are designated for the testing of fibers. Numerous configurations which fulfill this purpose are also available from MTS Systems Co. All fiber testing was done using a one-inch gauge length and 500 mm/minute grip separation speed. A bundle of 30 fibers was threaded into the grips with care taken to minimize the chance for any contamination. An extrapolated diameter for the fiber bundle was determined from the average diameter of the individual fibers determined via optical microscopy and converted into a theoretical diameter for the fiber bundle as if it were a single fiber. In each experiment, the fiber bundle was stretched until. breakage occurred. The software created a stress-versus-strain plot and calculated the mechanical properties for the sample. Mechanical properties of interest in the study are break stress and percent strain at the break. Five replicates were run and a statistical analysis performed. In each run, the fiber was stretched until breakage occurred. As previously stated, the software creates a stress-versus-strain plot and calculates the desired mechanical properties for the sample. The mechanical properties can include, for example, Young's modulus, stress at break, and percent strain or elongation at break.

The results of various tests conducted on the Examples are presented in the Tables below. As a control, grafted PEO monofilament fibers were measured. The free fall grafted PEO fibers had a break stress of 11.2 MPa and a strain-at-break of 850 percent. The fiber drawn at 300 m/min had a break stress of 6.2 MPa and strain-at-break of 330 percent. The grafted PEO/PP 1/1 bicomponent fiber had significantly improved strength and tenacity.

For example, the break stress increased from 6.2 MPa to 84 MPa for fibers drawn at 300 m/min. Moreover, the break stress was found to dramatically improve for PEO bicomponent fibers containing a greater amount of grafted PEO. The break stress increased to 1040 MPa for the grafted PEO/PP 2/1 bicomponent fibers. This is quite surprising since grafted PEO is a relatively weaker fiber material than PP.

TABLE 2

DRY TENSILE PROPERTIES OF GRAFTED PEO MONOCOMPONENT FIBERS VERSUS GRAFTED PEO/PP BICOMPONENT FIBERS

| | Grafted PEO Monofilament | | Grafted PEO/PP at 1/1 | | Grafted PEO/PP at 2/1 | |
|---|---|---|---|---|---|---|
| Property | Free fall | 300 m/min | Free fall | 300 m/min | Free fall | 300 m/min |
| Diameter* | 154 | 325 | 205 | 159 | 180 | 39 |
| Break Stress | 11.2 | 6.2 | 30 | 84 | 22 | 1040 |
| Strain-at-Break | 850 | 330 | 870 | 320 | 800 | 260 |
| Modulus (MPa) | 85 | 35 | 240 | 240 | 150 | 4320 |
| Tenacity (g/denier) | 0.17 | 0.52 | 0.84 | 1.4 | 0.49 | 1.09 |

The tensile properties for the grafted PEO/PLA bicomponent fibers are given in Table 3 below. Once again, the bicomponent fibers containing PLA as the water-insoluble core material had substantially improved strength as compared to grafted PEO monofilament fibers. The bicomponent fibers drawn at 500 m/min were unusually strong, with a break stress of 2360 MPa.

TABLE 3

DRY TENSILE PROPERTIES OF GRAFTED PEO MONOCOMPONENT FIBERS VERSUS GRAFTED PEO/PLA BICOMPONENT FIBERS

| | Grafted PEO Monofilament | | Grafted PEO/PLA at 1/1 | | Grafted PEO/PLA at 2/1 | | |
|---|---|---|---|---|---|---|---|
| Property | Free fall | 300* m/min | Free fall | 400 m/min | Free fall | 400 m/min | 500 m/min |
| Diameter* | 154 | 325 | 231 | 106 | 195 | 64 | 25 |
| Break Stress | 11.2 | 6.2 | 16.9 | 84 | 16.3 | 370 | 2360 |
| Strain-at-Break | 850 | 330 | 4 | 68 | 4 | 115 | 46 |
| Modulus (MPa) | 85 | 35 | 480 | 2090 | 450 | 2610 | 11,890 |
| Tenacity (g/denier) | 0.17 | 0.52 | 0.59 | 2.40 | 0.42 | 1.05 | 0.98 |

Wet Tensile Properties

To evaluate the suitability of the bicomponent fibers disclosed in the present invention for flushable applications, the bicomponent fibers were subject to a wet tensile test by submerging the sample grips of a SINTECH tensile tester in a tank of tap water at ambient temperature of about 22° C. The test results for the grafted PEO/PP bicomponent fibers are given in Table 4 below. When the fibers were submerged in water, the grafted PEO sheath begin to swell and then started to dissolve in water leading to a slimy surface which is desirable for flushing in a toilet due to reduced drag. It was surprisingly discovered that the bicomponent fibers become more ductile and tougher as shown by the significantly increased strain-at-break, 115 percent and 169 percent increase over the dry bicomponent fibers for free fall and drawn fibers respectively. Since the dissolution of the water-soluble exterior is expected to reduce the wet tensile properties of the bicomponent fiber, the toughness improvement is shown by the increase in the tenacity of the bicomponent fibers.

Similar improvements in wet tensile properties were also found for the grafted PEO/PLA bicomponent fibers as shown in Table 4 below. It was found that the strain at break of the free fall fibers increased from 4 percent when dry to 950 percent when wet. The tenacity was also found to have increased from dry to wet, especially for the free fall bicomponent, fibers.

TABLE 4

DRY AND WET TENSILE PROPERTIES OF GRAFTED PEO/PP AND GRAFTED PEO/PLA BICOMPONENT FIBERS

| | Grafted PEO/PP 2/1, Free Fall | | Grafted PEO/PP 2/1, 300 m/min | | Grafted PEO/PLA 2/1, Free Fall | | Grafted PEO/PLA 2/1, 400 m/min | |
|---|---|---|---|---|---|---|---|---|
| Property | Wet | Dry | Wet | Dry | Wet | Dry | Wet | Dry |
| Diameter* | 180 | 180 | 39 | 39 | 195 | 195 | 64 | 35 |
| Break Stress | 22 | 74* | 1040 | 1344* | 16.3 | 56.6* | 370 | 1420* |
| Strain-at-Break | 800 | 1720 | 260 | 700 | 4 | 950 | 115 | 170 |
| Modulus (MPa) | 150* | 38 | 4320 | 800* | 450 | 190* | 4320 | 3300* |
| Tenacity (g/denier) | 0.49 | 1.55 | 1.09 | 1.35 | 0.42 | 1.42 | 1.05 | 1.22 |
| | Percent Loss in Properties From Dry to Wet | | | | | | | |
| Break Stress | +236% | | +29% | | +247% | | +283% | |
| Strain-at-Break | +115% | | +169% | | +23,600% | | +48% | |
| Modulus (MPa) | −74% | | −81% | | −57% | | +26% | |
| Tenacity (g/denier) | +221% | | +23% | | +238% | | +16% | |

The present invention has been illustrated in great detail by the above specific Examples. It is to be understood that these Examples are illustrative embodiments and that this invention is not to be limited by any of the Examples or details in the Description. Those skilled in the art will recognize that the present invention is capable of many modifications and variations without departing from the scope of the invention. Accordingly, the Detailed Description and Examples are meant to be illustrative and are not meant to limit in any manner the scope of the invention as set forth in the following claims. Rather, the claims appended hereto are to be construed broadly within the scope and spirit of the invention.

We claim:

1. A multicomponent fiber having a core portion and a sheath portion, wherein the fiber comprises:

a) a melt processable polymer in at least the core portion; and b) a grafted poly(ethylene oxide) in at least the sheath portion.

2. The multicomponent fiber of claim 1, wherein the exterior portion comprising a poly(ethylene oxide) comprises a majority of the of the sheath portion.

3. The multicomponent fiber of claim 1, wherein melt processable polymer that is not a poly(ethylene oxide) comprises an interior core portion of the multicomponent fiber and the sheath portion comprising a grafted poly (ethylene oxide) comprises a majority of the sheath portion.

4. The multicomponent fiber of claim 1, wherein melt processable polymer that is not a poly(ethylene oxide) and the sheath portion comprising a grafted poly(ethylene oxide) are in a side by side configuration and the grafted poly (ethylene oxide) comprises a majority of the sheath portion.

5. The multicomponent fiber of claim 1, wherein the melt processable polymer that is not a poly(ethylene oxide) is a water-insoluble polymer.

6. The multicomponent fiber of claim 1, wherein the melt processable polymer that is not a poly(ethylene oxide) is a hydrolytically-degradable polymer.

7. The multicomponent fiber of claim 1, wherein the melt processable polymer that is not a poly(ethylene oxide) is a hydrolytically-degradable, aliphatic polyester.

8. The multicomponent fiber of claim 1, wherein the melt processable polymer that is not a grafted poly(ethylene oxide) is a polyolefin or a hydrolytically-degradable, aliphatic polyester.

9. The multicomponent fiber of claim 1, wherein the poly(ethylene oxide) is a grafted poly(ethylene oxide).

10. The multicomponent fiber of claim 1, wherein the grafted poly(ethylene oxide) is grafted with α,β-unsaturated moieties.

11. The multicomponent fiber of claim 1, wherein the grafted poly(ethylene oxide) is grafted with polar, vinyl monomers; polar, vinyl oligomers; polar, vinyl polymers; or a combination thereof.

12. The multicomponent fiber of claim 10, wherein the grafted poly(ethylene oxide) is grafted with polar, vinyl monomers; polar, vinyl oligomers; polar, vinyl polymers; or a combination there of selected from the group consisting of acrylates, methacrylates, 2-hydroxyethyl acrylate, 2-hydroxyethyl methacrylate, poly(ethylene glycol) acrylates, poly(ethylene glycol) methacrylates, poly (ethylene glycol) diacrylates, acrylic acid, methacrylic acid, maleic anhydride, itaconic acid, acrylamide, glycidyl methacrylate, 2-bromoethyl acrylate, 2-bromoethyl methacrylate, carboxyethyl acrylate, sodium acrylate, 3-hydroxypropyl methacrylate, 3-hydroxypropyl acrylate, 2-chloroacrylonitrile, 4-chlorophenyl acrylate, 2-cyanoethyl acrylate, glycidyl acrylate, 4-nitrophenyl acrylate, pentabromophenyl acrylate, poly(propylene glycol) acrylates, poly (propylene glycol) methacrylates 2-propene-1-sulfonic acid and its sodium salt, 2-sulfoethyl acrylate, 2-sulfoethyl methacrylate, 3-sulfopropyl acrylate, 3-sulfopropyl methacrylate, poly(ethylene glycol) alkyl ether acrylates, poly(ethylene glycol) alkyl ether methacrylates, poly (ethylene glycol) ethyl ether acrylates, poly(ethylene glycol) ethyl ether methacrylates and derivatives and analogs thereof.

13. The multicomponent fiber of claim 1, wherein the grafted poly(ethylene oxide) is grafted with α,β-unsaturated moieties selected from the group consisting of poly(ethylene glycol) acrylate, poly(ethylene glycol) methacrylate, and derivatives and combinations thereof.

14. The multicomponent fiber of claim 1, wherein the grafted poly(ethylene oxide) is grafted with 2-hydroxyethyl methacrylate. 2-hydroxyethyacrylate, 3-hydroxypropyl acrylate, 3-hydroxypropyl methacrylate and their analogs.

15. The multicomponent fiber of claim 1, wherein the grafted poly(ethylene oxide) is grafted with poly(ethylene glycol) ethyl ether methacrylate.

16. The multicomponent fiber of claim 1, wherein the grafted poly(ethylene oxide) is a graft copolymer of poly (ethylene oxide) having an molecular weight of from about 50,000 g/mol to about 8,000,000 g/mol prior to grafting that is grafted with about 0.1 to about 20 weight percent of polar vinyl monomer relative to the weight of poly(ethylene oxide).

17. The multicomponent fiber of claim 1, wherein the grafted poly(ethylene oxide) is a graft copolymer of poly (ethylene oxide) having an molecular weight of from about 50,000 g/mol to about 400,000 g/mol prior to grafting that is grafted with about 0.1 to about 20 weight percent of polar vinyl monomer relative to the weight of poly(ethylene oxide).

18. The multicomponent fiber of claim 1, wherein the grafted poly(ethylene oxide) is a graft copolymer of poly (ethylene oxide) having an molecular weight of from about 50,000 g/mol to about 300,000 g/mol prior to grafting that is grafted with about 0.1 to about 20 weight percent of polar vinyl monomer relative to the weight of poly(ethylene oxide).

19. The multicomponent fiber of claim 1, wherein the grafted poly(ethylene oxide) is a graft copolymer of poly (ethylene oxide) having an molecular weight of from about 50,000 g/mol to about 200,000 g/mol prior to grafting that is grafted with about 0.1 to about 20 weight percent of polar vinyl monomer relative to the weight of poly(ethylene oxide).

20. The multicomponent fiber of claim 1, wherein the grafted poly(ethylene oxide) is a graft copolymer of poly (ethylene oxide) having an molecular weight of from about 50,000 g/mol to about 8,000,000 g/mol prior to grafting that is grafted with about 2.5 to about 15 weight percent of polar vinyl monomer relative to the weight of poly(ethylene oxide).

21. The multicomponent fiber of claim 1, wherein the sheath portion comprising a poly(ethylene oxide) is a majority of an outermost layer of the multicomponent fiber.

22. The multicomponent fiber of claim 1, wherein the melt processable polymer that is not a poly(ethylene oxide) comprises a blend of polymers.

23. The multicomponent fiber of claim 3, wherein the interior core portion of the fiber is water sensitive.

24. The multicomponent fiber of claim 23, wherein the interior core portion of the fiber is water disintegratable.

25. The multicomponent fiber of claim 23, wherein the interior core portion of the fiber is water weakenable.

26. The multicomponent fiber of claim 23, wherein the interior core portion of the fiber is water dispersible.

27. A fabric comprising a plurality of non-woven fibers of claim 1.

28. An article comprising a plurality of multicomponent fibers of claim 1.

29. A multicomponent fiber comprising:

a) a core comprising a melt processable polymer that is not a grafted poly(ethylene oxide);

b) and a sheath comprising a grafted poly(ethylene oxide) surrounding the core, wherein the sheath comprises a majority of an exterior surface of the multicomponent fiber.

30. The multicomponent fiber of claim 29, wherein the core comprises a blend of more than one polymer.

* * * * *